US006932014B1

(12) United States Patent
Baucum et al.

(10) Patent No.: US 6,932,014 B1
(45) Date of Patent: Aug. 23, 2005

(54) MOORING PAD FOR WATERCRAFT

(76) Inventors: Omer Baucum, 8045 Davis Dr., Clayton, MO (US) 63105; Vera Baucum, 8045 Davis Dr., Clayton, MO (US) 63105

( * ) Notice: Subject to any disclaimer, the term of this patent is extended or adjusted under 35 U.S.C. 154(b) by 0 days.

(21) Appl. No.: 10/819,070

(22) Filed: Apr. 6, 2004

(51) Int. Cl.[7] ..... B63B 59/02

(52) U.S. Cl. ..... 114/219

(58) Field of Search ..... 405/1; 114/219, 114/263

(56) References Cited

U.S. PATENT DOCUMENTS

| | | | | |
|---|---|---|---|---|
| 3,055,022 | A * | 9/1962 | Vallquist | 114/343 |
| 4,815,412 | A * | 3/1989 | Cassaro, Jr. | 114/343 |
| 4,962,719 | A | 10/1990 | Hughes et al. | |
| 5,398,631 | A * | 3/1995 | Miller | 114/219 |
| 5,577,455 | A | 11/1996 | Dvorak | |

* cited by examiner

*Primary Examiner*—Ed Swinehart

(57) ABSTRACT

A mooring pad for watercraft that provides a protective shoreline pad to support and protect the hull of a watercraft. The mooring pad comprises a waterproof pad having a density greater than water. At least one flotation member is connected to the pad side edge.

3 Claims, 4 Drawing Sheets

MOORING PAD FOR WATERCRAFT

BACKGROUND OF THE INVENTION

1. Field of the Invention

The present invention relates to a mooring pad for watercraft for use in connection with watercraft protective accessories. The mooring pad for watercraft has particular utility in connection with mooring pads having side mounted flotation elements for positioning.

2. Description of the Prior Art

Mooring pads for watercraft are desirable to protect the bottom surface of a boat from rocks and other hard objects along the shoreline. At present a watercraft must be beached to position equipment for the watercraft to be removed from the water. A need was felt for a mooring pad which included side positioning flotation elements to aid in lining up the watercraft with the protector.

The use of watercraft protective accessories is known in the prior art. For example, U.S. Pat. No. 5,577,455 to Dvorak discloses a watercraft protection mat that is to be placed at the shoreline prior to beaching of a watercraft. The watercraft, when being beached, is to have its hull to be maneuvered onto the mat. The mat is to include appropriate openings to facilitate its connection with a plurality of fasteners that function as a tie down arrangement to secure the mat in position at the shoreline. The heads of the fasteners are to be covered by a covering flap when the mat is in use. The mat is to include appropriate weights so that it will sink within the water. The weights are each to include loose particulate matter that will conform to irregular shapes located at the shore insuring that the mat will rest evenly on the shore. The mat also includes elongated rigid members which function as stiffeners to keep the mat from bunching up, thereby retaining its established position. The mat is to be constructed of a plurality of layers with there being a cushiony layer located in between a top layer and a bottom layer. However, the Dvorak '455 patent does not include side-mounted flotation elements.

Similarly, U.S. Pat. No. 4,962,719 to Hughes et al. discloses a protective boat hull device is disclosed to prevent damage to a boat hull during beaching. An elongated flexible and waterproof sheet is provided having a length substantially greater than the width thereof, and capable of being wound into a roll along the elongated length thereof for storage purposes. The sheet includes a centering notch extending across the width of one end of the sheet for engaging the front hull of the boat above the water line, in order to center the sheet underneath the hull of the boat below the water line and prevent hull damage during beaching of the boat. The sheet further includes fastening means to facilitate attachment and detachment of the sheet relative to the boat. However, the Hughes et al. '719 patent does not include side-mounted flotation elements.

Lastly, United States Patent Number Des 370,657 to Block, Jr. discloses a boat hull protector that forms a protective bib strapped to the front of the watercraft. However, the Block, Jr. '657 patent does not include side-mounted flotation elements.

While the above-described devices fulfill their respective, particular objectives and requirements, the aforementioned patents do not describe a mooring pad for watercraft that allows mooring pads having side mounted flotation elements for positioning. The Dvorak '455, Hughes et al. '719 and Block, Jr. '657 patents make no provision for including side-mounted flotation elements.

Therefore, a need exists for a new and improved mooring pad for watercraft which can be used for mooring pads having side mounted flotation elements for positioning. In this regard, the present invention substantially fulfills this need. In this respect, the mooring pad for watercraft according to the present invention substantially departs from the conventional concepts and designs of the prior art, and in doing so provides an apparatus primarily developed for the purpose of mooring pads having side mounted flotation elements for positioning.

SUMMARY OF THE INVENTION

In view of the foregoing disadvantages inherent in the known types of watercraft protective accessories now present in the prior art, the present invention provides an improved mooring pad for watercraft, and overcomes the above-mentioned disadvantages and drawbacks of the prior art. As such, the general purpose of the present invention, which will be described subsequently in greater detail, is to provide a new and improved mooring pad for watercraft and method which has all the advantages of the prior art mentioned heretofore and many novel features that result in a mooring pad for watercraft which is not anticipated, rendered obvious, suggested, or even implied by the prior art, either alone or in any combination thereof.

To attain this, the present invention essentially comprises a waterproof pad having a density greater than water. At least one flotation member is connected to the pad side edge.

There has thus been outlined, rather broadly, the more important features of the invention in order that the detailed description thereof that follows may be better understood and in order that the present contribution to the art may be better appreciated.

The invention may also include a pad top rib, a pad bottom rib, a side eyelet and a buoy line. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mooring pad for watercraft that has all of the advantages of the prior art watercraft protective accessories and none of the disadvantages.

It is another object of the present invention to provide a new and improved mooring pad for watercraft that may be easily and efficiently manufactured and marketed.

An even further object of the present invention is to provide a new and improved mooring pad for watercraft that has a low cost of manufacture with regard to both materials and labor, and which accordingly is then susceptible of low prices of sale to the consuming public, thereby making such mooring pad for watercraft economically available to the buying public.

Still another object of the present invention is to provide a new mooring pad for watercraft that provides in the apparatuses and methods of the prior art some of the advantages thereof, while simultaneously overcoming some of the disadvantages normally associated therewith.

Lastly, it is an object of the present invention is to provide a mooring pad for watercraft for mooring pads having side mounted flotation elements for positioning.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
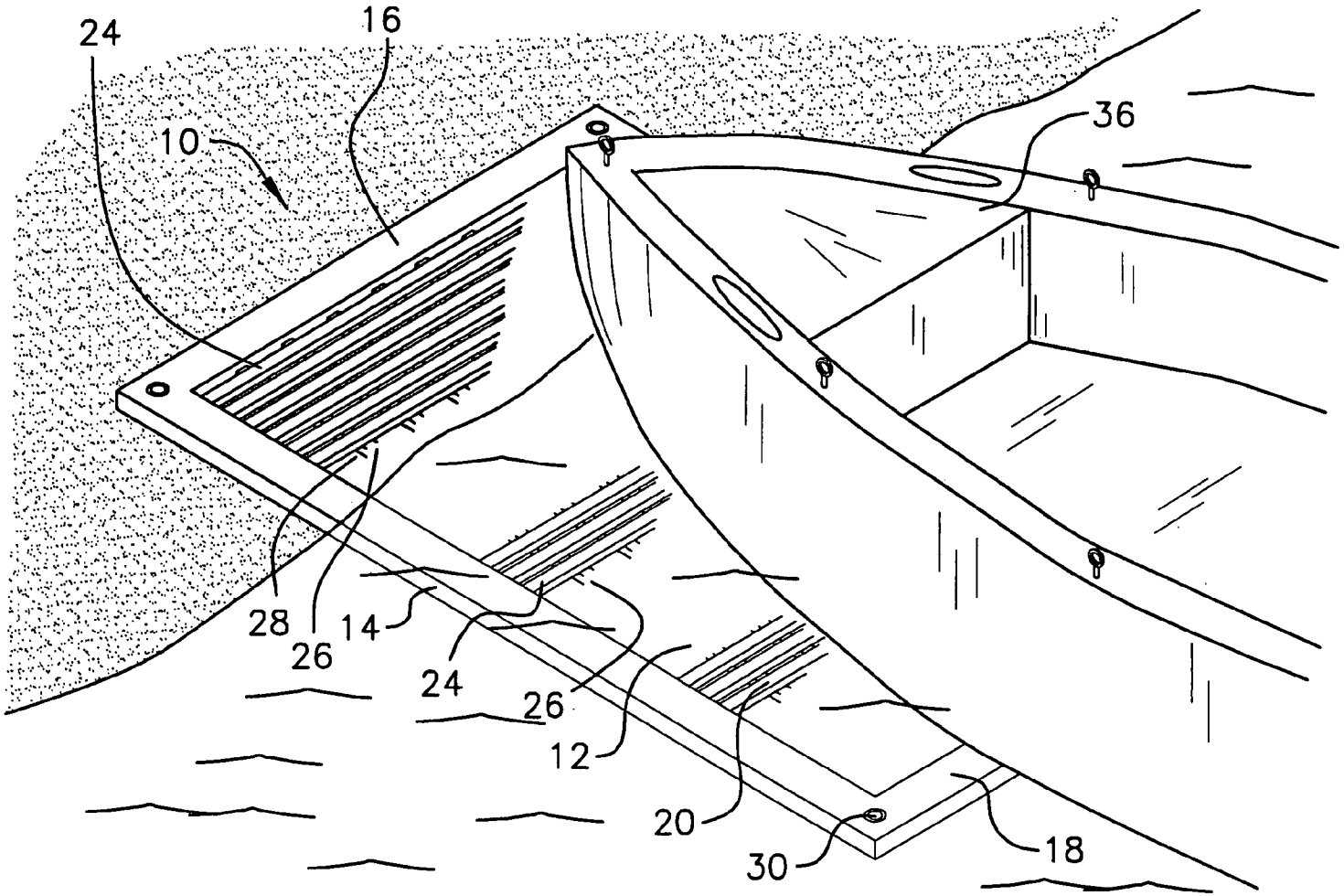
FIG. 1 is a top perspective view of the preferred embodiment of the mooring pad for watercraft constructed in accordance with the principles of the present invention.

Referring now to the drawings, and particularly to FIGS. 1–6, a preferred embodiment of the mooring pad for watercraft of the present invention is shown and generally designated by the reference numeral 10.

In FIG. 1, a new and improved mooring pad for watercraft 10 of the present invention for mooring pads having side mounted flotation elements for positioning is illustrated and will be described. More particularly, a pad 12 is waterproof. The pad 12 has the density greater than water. The pad 12 has a side edge 14. The pad 12 has a perforation 28 to allow water to pass therethrough. The pad 12 has a leading edge 16. The pad 12 has a trailing edge 18. The pad 12 is comprised of rubber. At least one pad top rib 24 is connected to the pad side edge 14. The pad top rib 24 has a textured surface 20 for contacting a watercraft 36. At least one pad bottom rib 26 is integrally connected to the pad top rib 24. At least one side eyelet 30 is connected adjacent to the pad side edge 14.

Figure 2:
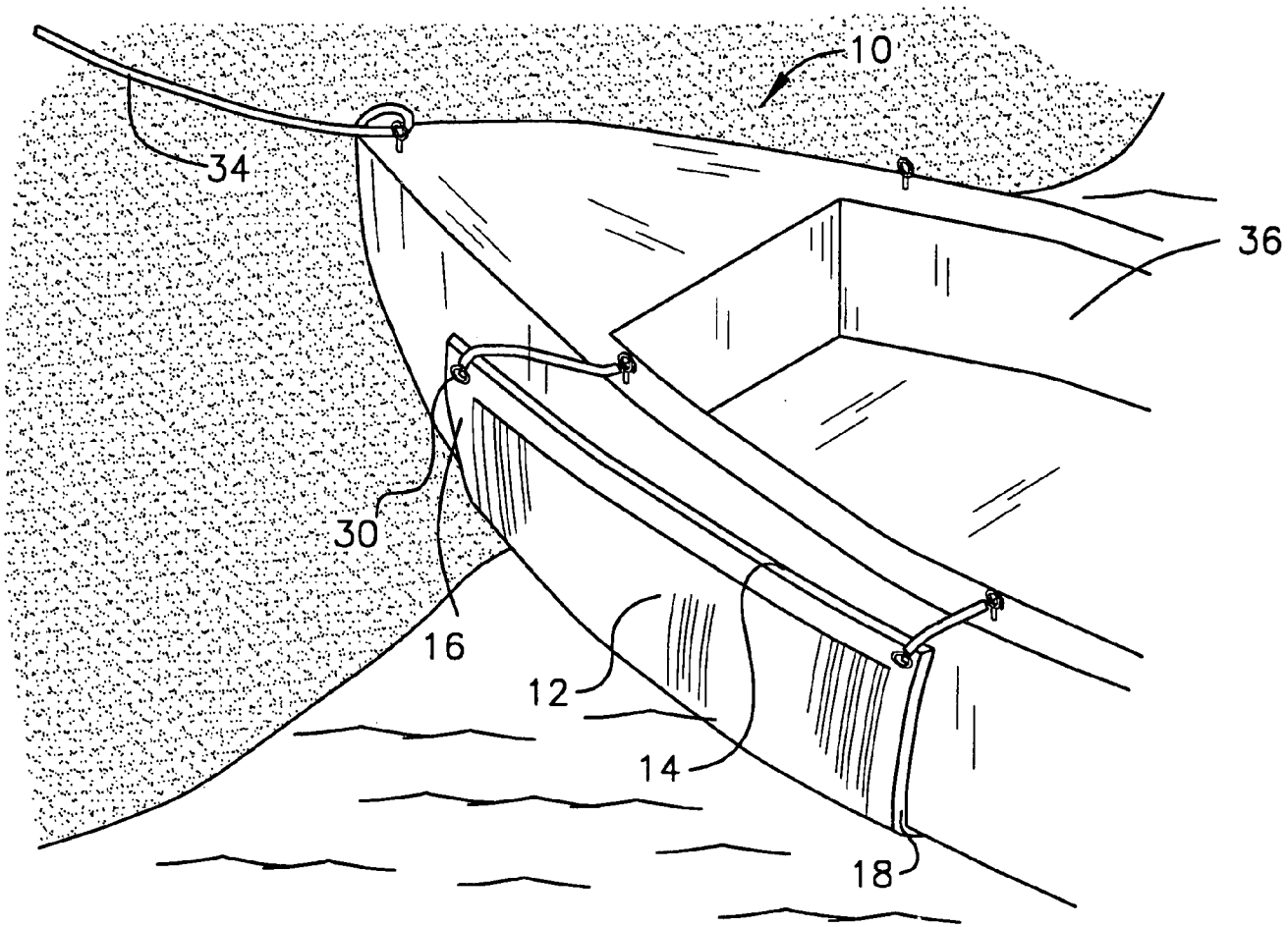
FIG. 2 is a top perspective view of the mooring pad for watercraft of the present invention.

In FIG. 2, the mooring pad for watercraft 10 is illustrated and will be described. More particularly, the pad 12 is waterproof. The pad 12 has the density greater than water. The pad 12 has the side edge 14. The pad 12 has the perforation 28 to allow water to pass therethrough. The pad 12 has the leading edge 16. The pad 12 has the trailing edge 18. The pad 12 is comprised of rubber. The side eyelet 30 is connected adjacent to the pad side edge 14.

Figure 3:
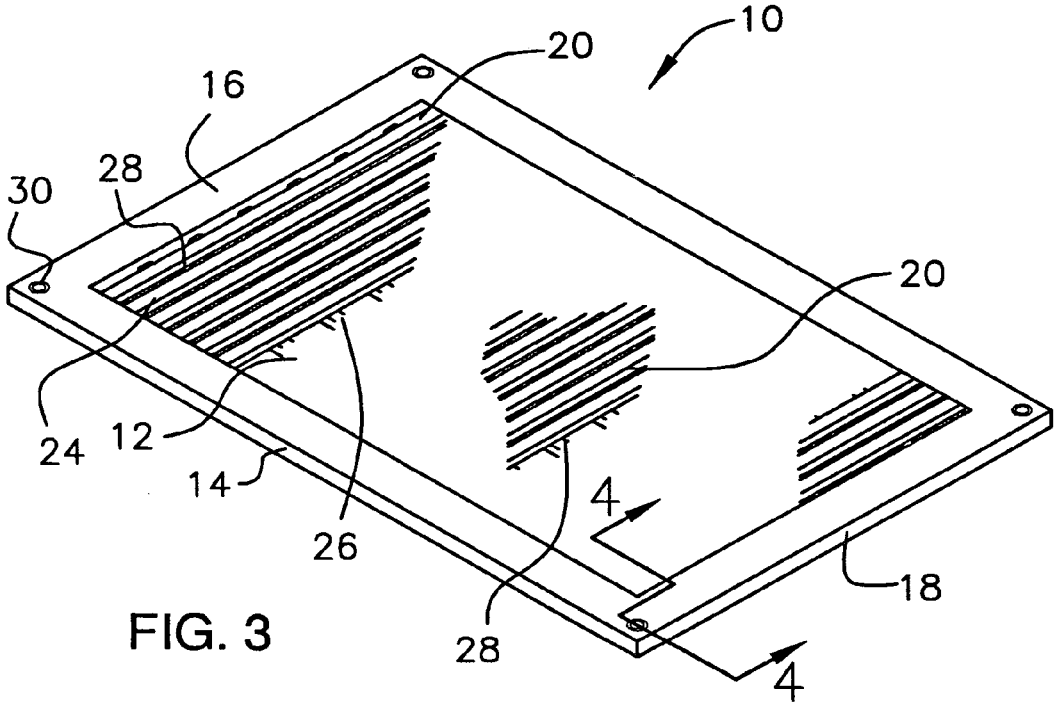
FIG. 3 is a top perspective view of the mooring pad for watercraft of the present invention.

In FIG. 3, the mooring pad for watercraft 10 is illustrated and will be described. More particularly, the pad 12 is waterproof. The pad 12 has the density greater than water. The pad 12 has the side edge 14. The pad 12 has the perforation 28 to allow water to pass therethrough. The pad 12 has the leading edge 16. The pad 12 has the trailing edge 18. The pad 12 is comprised of rubber. The pad top rib 24 is connected to the pad side edge 14. The pad top rib 24 has the textured surface 20 for contacting the watercraft 36. The pad bottom rib 26 is integrally connected to the pad top rib 24. The side eyelet 30 is connected adjacent to the pad side edge 14.

Figure 4:
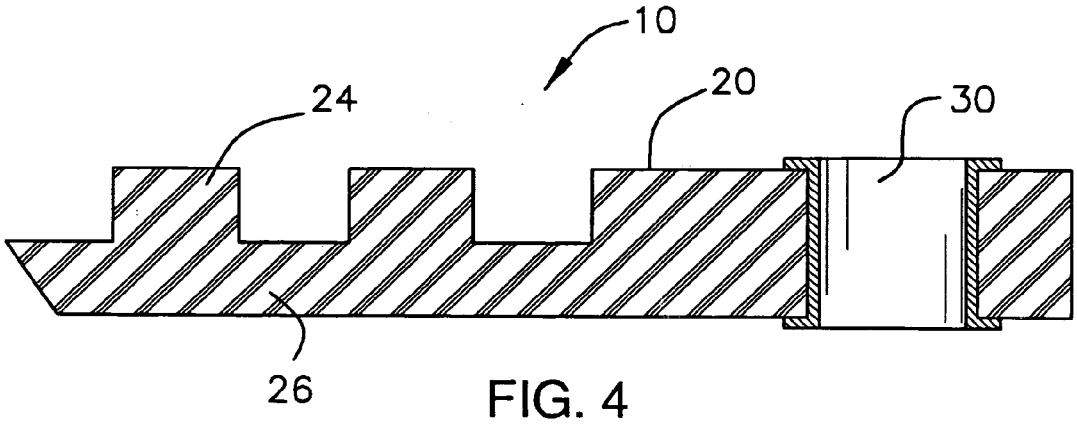
FIG. 4 is a section 4—4 view of FIG. 3 of the mooring pad for watercraft of the present invention.

In FIG. 4, the mooring pad for watercraft 10 is illustrated and will be described. More particularly, the pad 12 is waterproof. The pad 12 has the density greater than water. The pad top rib 24 is connected to the pad side edge 14. The pad top rib 24 has the textured surface 20 for contacting the watercraft 36. The pad bottom rib 26 is integrally connected to the pad top rib 24. The side eyelet 30 is connected adjacent to the pad side edge 14.

Figure 5:
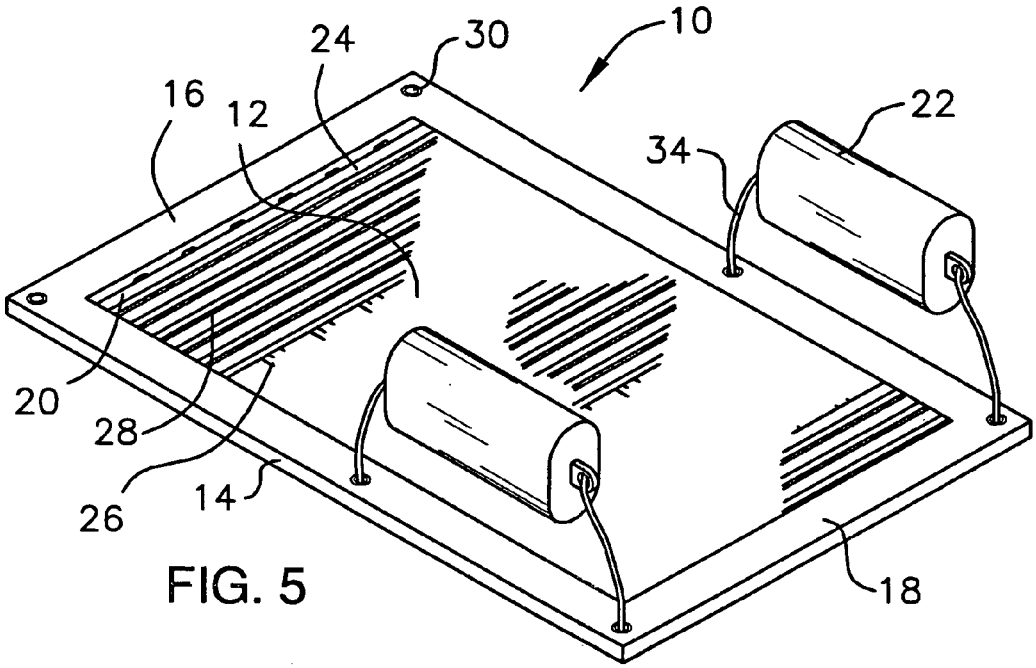
FIG. 5 is a top perspective view of the mooring pad for watercraft of the present invention.

In FIG. 5, the mooring pad for watercraft 10 is illustrated and will be described. More particularly, the pad 12 is waterproof. The pad 12 has the density greater than water. The pad 12 has the side edge 14. The pad 12 has the perforation 28 to allow water to pass therethrough. The pad 12 has the leading edge 16. The pad 12 has the trailing edge 18. The pad 12 is comprised of rubber. At least one flotation member 22 is connected to the pad side edge 14. The pad top rib 24 is connected to the pad side edge 14. The pad top rib 24 has the textured surface 20 for contacting the watercraft 36. The pad bottom rib 26 is integrally connected to the pad top rib 24. The side eyelet 30 is connected adjacent to the pad side edge 14. A buoy line 34 is connected to the pad side edge 14. The flotation member 22 is connected to the buoy line 34.

Figure 6:
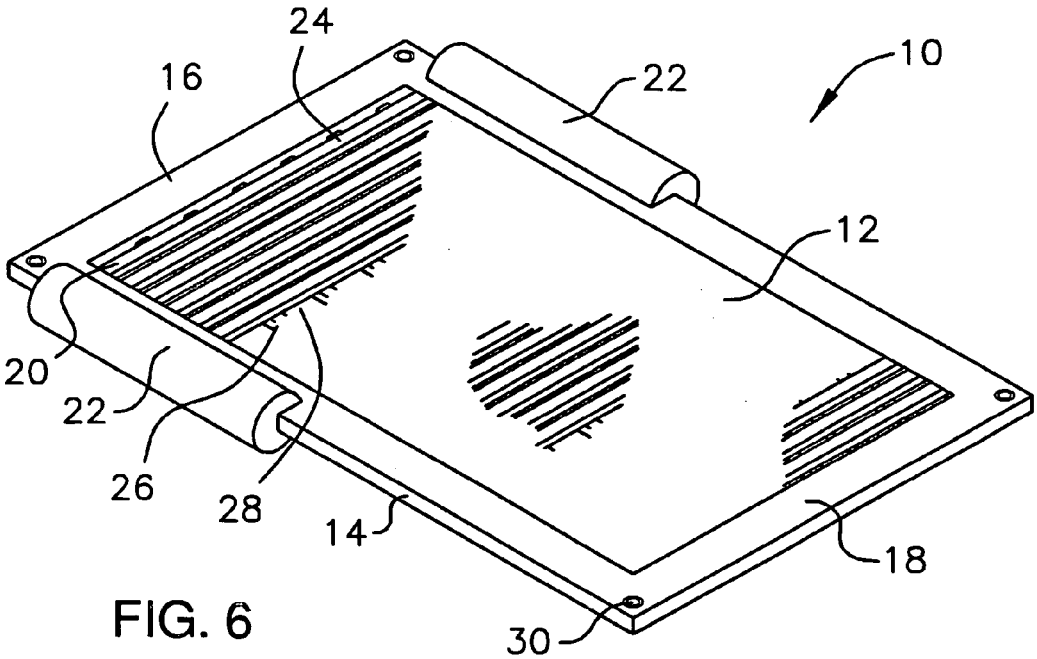
FIG. 6 is a top perspective view of the mooring pad for watercraft of the present invention.

In FIG. 6, the mooring pad for watercraft 10 is illustrated and will be described. More particularly, the pad 12 is waterproof. The pad 12 has the density greater than water. The pad 12 has the side edge 14. The pad 12 has the perforation 28 to allow water to pass therethrough. The pad 12 has the leading edge 16. The pad 12 has the trailing edge 18. The pad 12 is comprised of rubber. The flotation member 22 is connected to the pad side edge 14. The pad top rib 24 is connected to the pad side edge 14. The pad top rib 24 has the textured surface 20 for contacting the watercraft 36. The pad bottom rib 26 is integrally connected to the pad top rib 24. The side eyelet 30 is connected adjacent to the pad side edge 14. The flotation member 22 is substantially tube shaped and is connected to the pad side edge 14.

In use it can now be seen that when the mooring pad for watercraft 10 is to be moored, the pad would be placed in the edge of the water at the shoreline. Using the built in side eyelets 30 it may then be tied to the bow with rope or elastic cords. The pad could be tied to a stake or tree through the tie down eyelet 32. The watercraft could be pulled or driven up onto the pad thus protecting a watercraft hull from being scraped or damaged.

While a preferred embodiment of the mooring pad for watercraft has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable flexible material such as plastic may be used instead of the rubber described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A mooring pad for watercraft comprising:

a waterproof pad, said pad having a density greater than water, said pad having a left and right side edge, said pad having a perforation to allow water to pass therethrough, said pad has a leading edge, said pad has a trailing edge, said pad is comprised of rubber;

at least one flotation member connected to said pad left and right side edge to aid in lining up the watercraft;

at least one pad top rib is connected to said pad left and right side edge, said pad top rib has a textured surface for contacting said watercraft;

at least one pad bottom rib is integrally connected to said pad top rib;

at least one side eyelet connected adjacent to said pad left and right side edge.

2. The mooring pad for watercraft of claim 1 wherein:

said flotation member is substantially tube shaped and is connected to said pad left and right side edge.

3. The mooring pad for watercraft of claim 1 further comprising:

a buoy line connected to said pad; and said flotation member connected to said buoy line.

* * * * *